US005462385A

United States Patent [19]

Mohlengraft

[11] Patent Number: 5,462,385

[45] Date of Patent: Oct. 31, 1995

[54] MANHOLE COVER TOOL

[75] Inventor: John S. Mohlengraft, Upland, Calif.

[73] Assignee: GTE California Incorporated, Thousand Oaks, Calif.

[21] Appl. No.: 629,914

[22] Filed: Dec. 19, 1990

[51] Int. Cl.[6] ..... E02D 29/14; B66F 11/00; B66F 3/00

[52] U.S. Cl. ..... 404/25; 254/131; 414/684.3

[58] Field of Search ..... 404/25; 254/131; 294/15–19; 414/684.3

[56] References Cited

U.S. PATENT DOCUMENTS

| | | | |
|---|---|---|---|
| 2,655,399 | 10/1953 | McMillan | 254/131 |
| 3,362,684 | 1/1968 | Davenport | 254/131 |
| 4,365,786 | 12/1982 | Osteen | 254/131 |
| 4,488,706 | 12/1984 | Kono | 254/131 |
| 4,512,554 | 4/1985 | Racine | 254/131 |
| 4,662,607 | 5/1987 | Mochizuki et al. | 254/131 |
| 4,978,103 | 12/1990 | Moisan | 254/131 |
| 4,991,893 | 2/1991 | Gordon et al. | 254/131 X |

*Primary Examiner*—Kenneth J. Dorner

*Assistant Examiner*—Nancy Mulcare

*Attorney, Agent, or Firm*—John A. Odozynski

[57] ABSTRACT

A hand-operated tool for removing and replacing a wide variety of different manhole covers is disclosed. The tool includes a handle which extends upward from slip-resistant feet. A collar with forward extending ears attaches to the lower, central region of the handle. An S-hook is positioned within the ears so that its hook extends downward and frontward, and a clevis is positioned outside the ears. The S-hook, clevis, and ears are all bolted together. One end of a chain attaches to the clevis, and another end of the chain attaches to a link of an elongated link-up unit. The link-up unit's link is dimensioned for snug, but hand-removable, attachment to the S-hook. The snug attachment resists rotation between the link-up unit and the S-hook. A hook pivotably couples to the link-up unit at an opposing end from the link-up unit's link. The hook is coupled so that is can pivot up and down only, and cannot freely rotate around the general direction of elongation of the link-up unit. The hook extends downward and forward. The link-up unit is further configured to include an integrally formed claw. This claw extends rearward and slightly upward from the lower region of the link-up unit.

24 Claims, 3 Drawing Sheets

FIG. 1
(PRIOR ART)
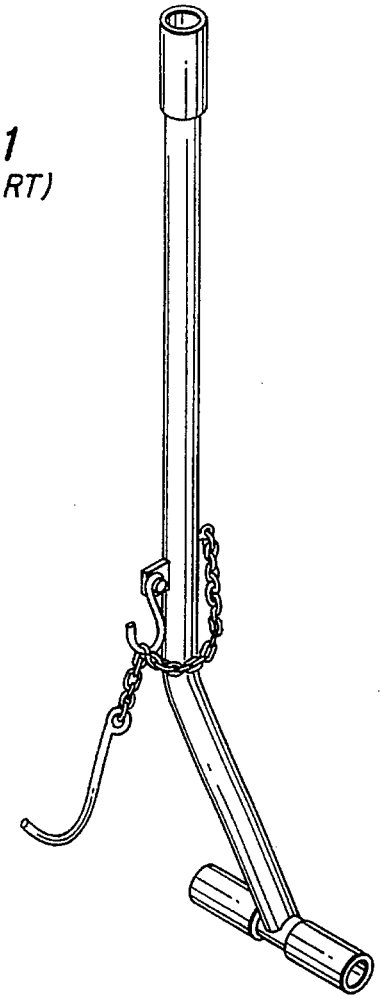
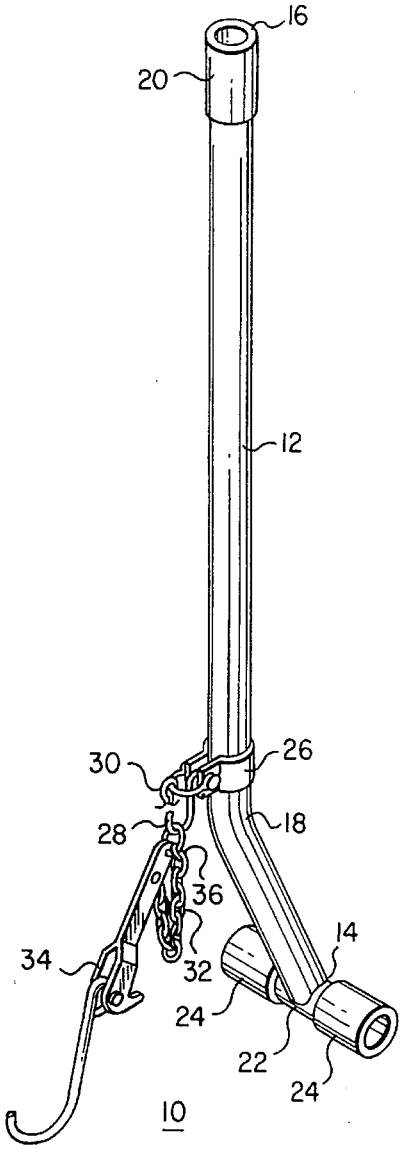
FIG. 2
FIG. 3
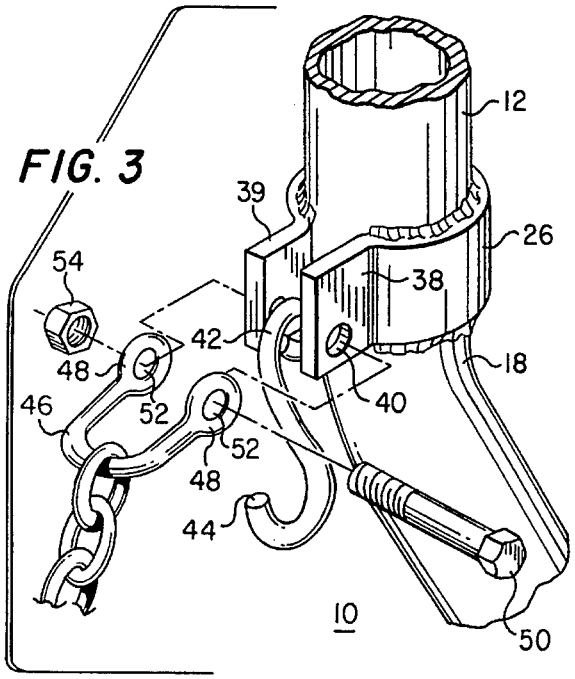

MANHOLE COVER TOOL

TECHNICAL FIELD OF THE INVENTION

The present invention relates generally to hand-operated tools. More specifically, the present invention relates to a tool for use in connection with the removal and installation of a wide variety of manhole covers.

BACKGROUND OF THE INVENTION

The removal and installation of manhole covers pose a problem for those who are charged with maintaining the infrastructure of utilities, such as the telephone system, the waterworks, the sewer system, and the like. A manhole cover may represent any one of a wide variety of heavy metallic and/or concrete structures which overlie an opening into an enclosed structure that is usually, but not necessarily, located underground. Manhole covers come in diverse sizes, shapes, and structures. They may be circular or rectangular in shape, and they may be hinged, as in connection with pull-box covers, or not hinged.

The problem connected with their removal and installation stems from their typically great weight, which is often up to 300 lbs. At this weight, a manhole cover is too heavy for a person to handle without help. However, the use of two or more persons to move the cover poses an impractical solution. The two-person solution is inefficient because it requires two persons in many situations where one person would otherwise suffice. In addition, it is unsafe because two person operations are awkward and present a greater chance of muscle strain and other injuries.

Thus, a tool is needed to help a single person manipulate the cover. Such tools have been devised and used in the utility industries. One such tool is a simple hook which allows for engagement with a manhole cover. However, the simple hook is unsatisfactory because it does not afford sufficient leverage. As a result, a person using a simple hook must bear the entire weight of the cover, and this burden risks injury to the person.

Another prior art tool is illustrated in FIG. 1. As shown in FIG. 1, a handle selectively couples to a chain, which in turn couples to a hook. The handle and its coupling to the chain allow the person to use leverage in manipulating a manhole cover. Thus, a person need not bear the entire weight of the cover and a certain type of injury is reduced. However, the tool shown in FIG. 1 poses different and substantial risks to a person using it. For example, the tool's hook has a tendency to twist when it engages a manhole cover and become instantly disengaged therefrom when great forces are being exerted. Persons operating the tool may find themselves flung backward, often in the face of oncoming traffic. In addition, such persons must at the same time dodge an oncoming hook which is flung toward them when it becomes disengaged from the cover.

The tool shown in FIG. 1 poses additional disadvantages. Persons charged with maintaining utility infrastructures often must deal with a wide variety of manhole cover configurations. While the FIG. 1 tool poses unnecessary risks to its operator in connection with any type of manhole cover, those risks increase when the tool is used in connection with types of manhole covers for which it was not designed to operate. It is impractical to carry many manhole cover tools, each one of which is specifically adapted for its own type of manhole cover configuration. Thus, such persons are urged to use the tool in dangerous situations because no better tools are available. Additionally, the FIG. 1 tool attaches its chain to its handle using a relatively small diameter eye bolt located on the side of the handle to keep the various pieces of the tool together. The proper use of the tool requires the chain to be hooked on an S-hook located on the front of the handle. Apparently this proper use is not obvious from viewing the tool. As a result, pulling operations are often performed using the eye bolt rather than the S-hook to transfer forces between the handle and the chain. Such operations cause damage to the tool.

SUMMARY OF THE INVENTION

Accordingly, it is an advantage of the present invention that a safe and improved manhole cover removal and replacement tool is provided.

Another advantage of the present invention is that a manhole cover removal and installation tool is provided which is adapted for safe use in connection with a wide variety of manhole cover configurations.

Yet another advantage is that the present invention provides a manhole cover removal and installation tool that minimizes the chances of improper tool use.

The above and other advantages of the present invention are carried out in one form by a manhole cover tool which engages a manhole cover residing in a first position and allows a person to safely reposition the manhole cover to a second position. The tool includes a rigid handle which extends from an anchoring end of the handle to a gripping end of the handle. The tool additionally includes a hook-shaped member which engages the manhole cover. A rotation restraining device couples between the hook-shaped member and the handle at a location between the handle's anchoring and gripping ends. The rotation restraining device restrains rotation of the hook-shaped member relative to the handle. This rotation is restrained in each of two dimensions when the hook-shaped member engages the manhole cover.

BRIEF DESCRIPTION OF THE DRAWINGS

A more complete understanding of the present invention may be derived by referring to the detailed description and claims when considered in connection with the FIGURES, wherein like reference numbers refer to similar items throughout the FIGURES, and:

FIG. 1 shows a prior art manhole cover tool over which the present invention represents an improvement;

FIG. 2 shows a perspective view of an improved manhole cover tool constructed in accordance with the present invention;

FIG. 3 shows an exploded, perspective view of a collar region of the present invention;

DETAILED DESCRIPTION OF THE PREFERRED EMBODIMENT

Figure 4:
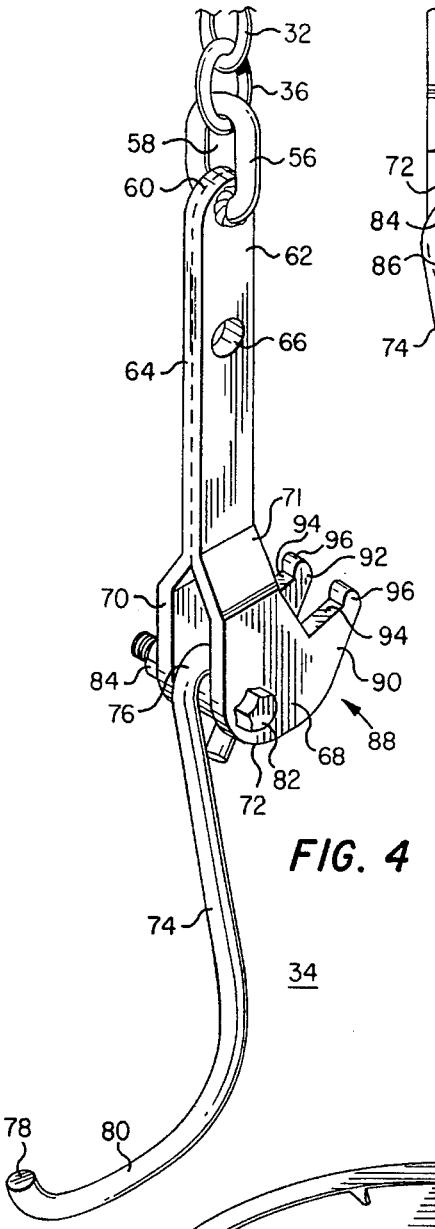
FIG. 4 shows a perspective view of a link-up unit portion of the present invention.

FIG. 2 shows a perspective view of a manhole cover tool 10 constructed in accordance with the teaching of the present invention. Tool 10 includes a rigid handle 12, formed from a steel pipe or similar structure, which extends from an anchor or lower end 14 to a gripping or upper end 16. Handle 12 is configured to include a bend 18 of a few degrees. Bend 18 causes handle 12 to curve toward the rear of tool 10 when progressing from one of ends 14–16 to the other. In addition, handle 12 includes a grip 20 positioned on handle 12 substantially adjacent to gripping end 16. Grip 20 consists of a knurled pattern on handle 12 or any conventional overlaying sleeve which enhances gripping abilities.

Tool 10 additionally includes a T-bar 22 rigidly and perpendicularly attached to handle 12 at anchor end 14. Handle 12 attaches to a central region of T-bar 22, and feet 24 are provided by overlying sleeves on T-bar 22. Feet 24 extend on either side of handle 12, from near handle 12 outward on T-bar 22 toward either end of T-bar 22. Feet 24 are constructed from rubber or another slip-resistant material and are held in place by appropriate fasteners (not shown). Preferably, feet 24 are held to T-bar 22 with "T" nuts and stove bolts to facilitate their replacement after they wear out.

A collar 26 surrounds handle 12 near and above bend 18. Collar 26 extends perpendicularly away from handle 12 in front of handle 12. Collar 26 couples to an S-hook 28 and a first end 30 of a chain 32. A link-up unit 34 permanently attaches to a second end 36 of chain 32 and additionally attaches to S-hook 28 in a hand-removable fashion. Chain 30 serves the dual purposes of keeping the various pieces of tool 10 fastened together and selectively transferring pulling forces between handle 12 and link-up unit 34 during manhole cover replacement operations. On the other hand, link-up unit 34 directly attaches to S-hook 28 during manhole cover removal and opening operations.

FIG. 3 shows a detailed view of tool 10 in the vicinity of collar 26. Specifically, ears 38 and 39 of collar 26 extend outward in front of handle 12. Ears 38–39 are spaced apart a sufficient distance, which is approximately ⅜ inch in the preferred embodiment, to accommodate the diameter of S-hook 28 therebetween. In addition, each of ears 38–39 has a hole 40 therein, and holes 40 are positioned in alignment with one another.

A first end 42 of S-hook 28 is formed into an eye, and an opposing end 44 of S-hook 28 remains an open hook. The open end of this hook points toward the front of tool 10, or away from handle 12. A clevis 46 is dimensioned to have approximately the same diameter as S-hook 28. Thus, it exhibits approximately the same strength for pulling operations as is exhibited by S-hook 28. In addition, ends 48 of clevis 46 are spaced apart from one another a sufficient distance so that ears 38–39 of collar 26 snugly fit between ends 48. Clevis 46 is inserted through the link in chain 32 that serves as first end 30 of chain 32. As shown in exploded fashion in FIG. 3, a bolt 50 is inserted through holes 52 in ends 48 of clevis 46, through holes 40 in ears 38–39, and through the eye at first end 42 of S-hook 28 so that these items are pinned together. A nut 54 may threadably couple to bolt 50 to prevent the removal of bolt 50.

FIG. 4 shows a detailed view of link-up unit 34. Starting at the top of link-up unit 34 and proceeding downward, a link 56 is inserted through the link in chain 32 that serves as second end 36 of chain 32. Link 56 is preferably formed from an approximately ⅜ inch diameter steel member. Link 56 has an elongated central opening 58, which is slightly larger than ⅜ inch wide and approximately 1 inch from top to bottom. The bottom end of link 56 rigidly attaches, such as by welding, to a top end 60 of an arm 62 of link-up unit 34. Arm 62 is an elongated steel member which extends downward from top end 60 for approximately 9½ inches. Arm 62 is at least 1¼ inches wide (from front to back) throughout this height, and approximately ⅜ inch thick from top end 60 downward through a shank region 64 of arm 62. A hole 66 extends through this thickness of arm 62 at a location approximately 2½ inches down from top end 60. Hole 66 is dimensioned to snugly, but removably, accommodate S-hook 28 (see FIG. 3).

In the preferred embodiment of tool 10, arm 62 is formed from two substantially identically shaped 3/16 inch steel straps which are arc welded together throughout shank region 64. At the bottom of shank region 64, these two sections are bent apart from one another to form left and right tines 68 and 70, respectively. Tines 68–70 angle away from one another (to the left and right) throughout a transition region 71. At the bottom of transition region 71 the inside surfaces of tines 68–70 are spaced approximately ⅝ inch apart from one another. Tines 68–70 remain spaced approximately this distance apart to a bottom end 72 of arm 62. Since the two steel straps which form arm 62 are substantially identical in shape, tines 68–70 are likewise substantially identical in shape.

A hook 74 couples to arm 62 near bottom end 72. Specifically, hook 74 extends from a top end 76, which is bent into an eye, downward and frontward for 6–10 inches to a bottom end 78. Preferably, hook 74 is formed from ⅜ inch steel. In addition, hook 74 is formed to exhibit a first radius of curvature throughout an intermediate region 80 of hook 74, then a second and smaller radius of curvature near bottom end 78 of hook 74. Preferably, the radii transition from the larger radius to the smaller radius within 1 inch of bottom end 78. In other words, the tip of hook 74 is bent inward.

Figure 5:
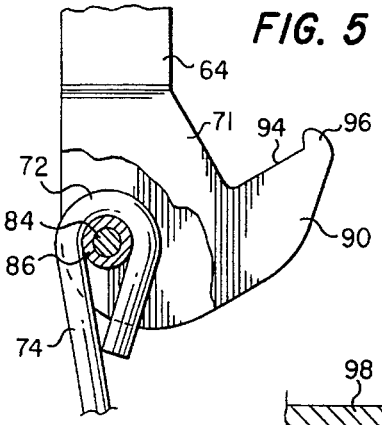
FIG. 5 shows a partial sectional view of a portion of the link-up unit of the present invention.

Hook 74 pivotably couples to arm 62 by positioning the eye at top end 76 of hook 74 between tines 68–70 in alignment with aligned holes (not shown) in tines 68–70. A bolt or pin 82 is inserted through tine 68, the eye, and tine 70 and held in place with an appropriate fastener, such as nut 84. Preferably, as shown in FIG. 5, a bushing 86 is used between bolt 82 and the eye of hook 74 and between tines 68–70. Bushing 86 is dimensioned to conform to the inner diameter of the eye in hook 74 to restrict any wobbling of hook 74. Moreover, bushing 86 permits hook 74 to freely pivot about bolt 82, while further permitting bolt 82 to firmly position tines 68–70 in a spaced apart relationship.

Arm 62 additionally includes a rearward extending claw 88 at the lower portion of arm 62. Claw 88 is formed from left and right fingers 90 and 92, respectively, which are integrally parts of tines 68–70, respectively. Fingers 90–92 have substantially identical shapes. Generally speaking, the lower portion of arm 62 is wider (front-to-back) than the upper portion of arm 62. Fingers 90–92 extend rearward and slightly upward with respect to the general direction of elongation of arm 62. As a result, the rearmost end of fingers 90–92 are around 3⅝ inches away from the front edge of arm 62 and more than 1 inch above bottom end 72 of arm 62. With the greater width of tines 68–70 in the lower region of arm 62, fingers 90–92 extend more than 1 inch to the rear of the body of arm 62. Fingers 90–92 are configured so that an upper surface portion 94 of fingers 90–92 resides at between a 45°–90° angle, and preferably around a 60° angle, with shank 64 of arm 62 (see FIG. 5). At the rearmost end of fingers 90–92, a stop 96 extends generally upward from surface 94. Stop 96 represents an approximately ⅛ inch circular bump integrally formed at the ends of fingers 90–92.

Figure 7:
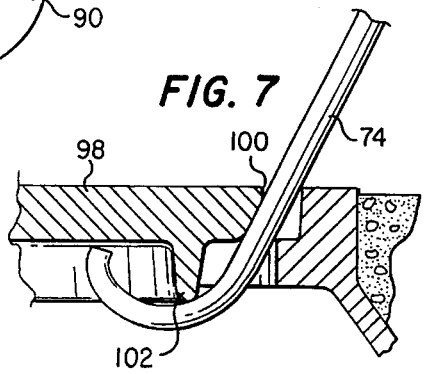
FIG. 7 shows a cross-sectional side view of the portion of FIG. 6 indicated by line 7—7.
Figure 6:
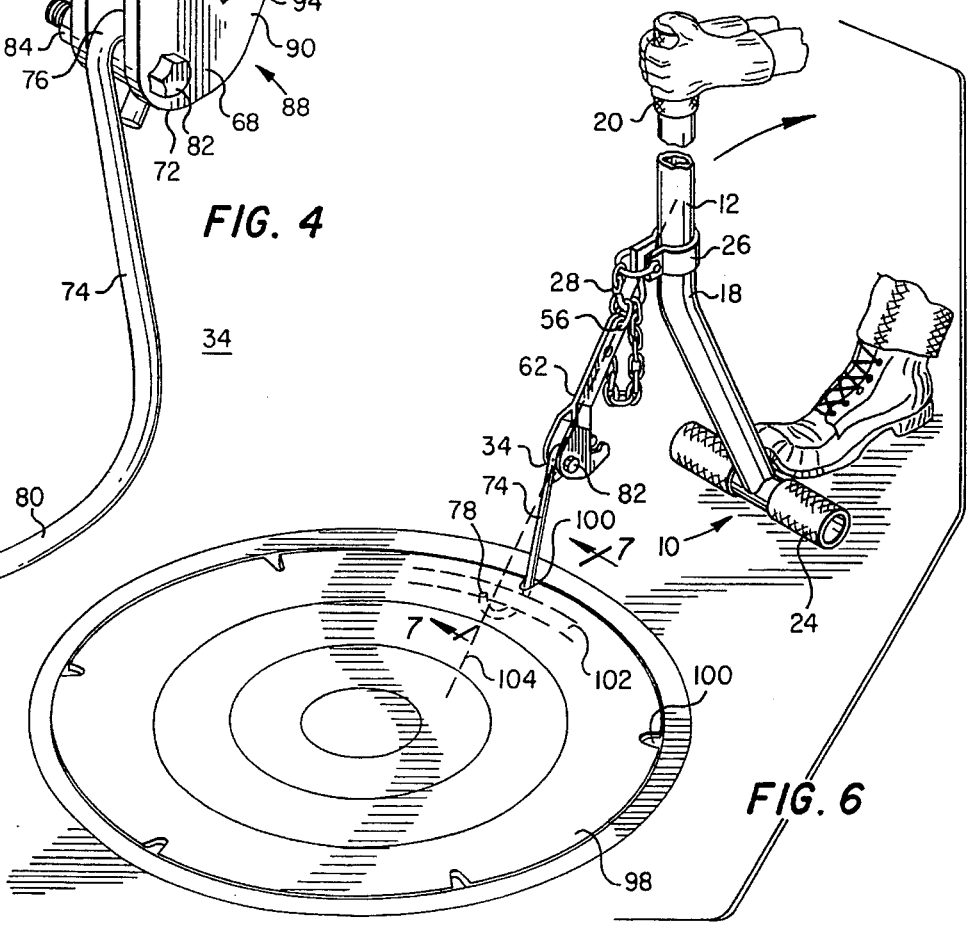
FIG. 6 shows the operation of the present invention in connection with a first type of manhole cover.

FIGS. 6–10 illustrate various modes of operating tool 10 in cooperation with various configurations of manhole covers. As shown in FIGS. 6–7, a manhole cover 98 has a plurality of inwardly extending notches 100 located around its perimeter. In addition, a series of concentric reinforcing ribs 102 are located on the underneath side of manhole cover 98. Tool 10 is positioned near manhole cover 98 with feet 24 on the ground and the upper region of handle 12 extending upright. Link 56 is coupled to S-hook 28 by inserting S-hook 28 into opening 58 (see FIG. 4). Hook 74 is inserted into one of notches 100 so that its tip or bottom end 78 resides within one of reinforcing ribs 102 and contacts the bottom surface of manhole cover 98 (see FIG. 7). Tool 10 raises manhole cover 98 upward then rearward when a rearward force is exerted at grip 20 of handle 12. Due at least in part to bend 18 in handle 12, T-bar 22 exerts a downward component of force into the ground, and this downward component of force reduces any tendency for feet 24 to move forward during the pulling operation.

Tool 10 is configured to restrict rotation of hook 74 in two dimensions during this removal operation while permitting rotation in a third dimension. Specifically, rotation about a generally vertical axis (not shown) defined by handle 12 is prevented by captivating hook 74 within a notch 100. In addition, rotation about an axis 104, which extends between hook 74 and collar 26 and is shown by a dotted line in FIG. 6, is restricted due to the operation of link-up unit 34.

The attachment of S-hook 28 to collar 26 and of hook 74 to arm 62 severely restricts wobbling or rotation around the general direction of elongation of arm 62. In addition, the generally tight coupling of link 56 to S-hook 28 restricts rotation around this direction. This restriction of rotation represents a significant difference from the free rotation in this dimension which is permitted by simply coupling a chain between a hook and a handle, as shown in FIG. 1. As a result of hook 74 remaining free from such rotations, hook 74 tends to remain engaged against manhole cover 98 and reinforcing rib 102 during the removal operation. Since it remains engaged, safety is enhanced because hook 74 does not tend to fly back toward a user of tool 10, causing the user to be flung backwards as well.

Moreover, the bent tip at bottom end 78 of hook 74 enhances the ability of hook 74 to remain in place against reinforcing rib 102 during the removal operation. Since it tends to remain in place, safety is further enhanced because hook 74 does not tend to fly back toward a user of tool 10.

On the other hand, hook 74 may freely pivot or rotate about an axis defined by bolt 82 and about a parallel axis at the coupling of S-hook 28 to link 56. Such pivoting permits hook 74 to remain in a desirable orientation with respect to manhole cover 98 throughout the removal operation. Rotation in this dimension further encourages the stable coupling of hook 74 to manhole cover 98. During the removal operation, tool 10 first lifts manhole cover 98 substantially vertical so that it can clear its frame. Later, after manhole cover 98 clears its frame, tool 10 exerts substantially horizontal forces to drag manhole cover 98 away from its frame. The use of multiple pivot points allows tool 10 to safely accommodate these different orientations as well as other orientations which occur when tool 10 is used with other types of manhole covers.

Figure 8:
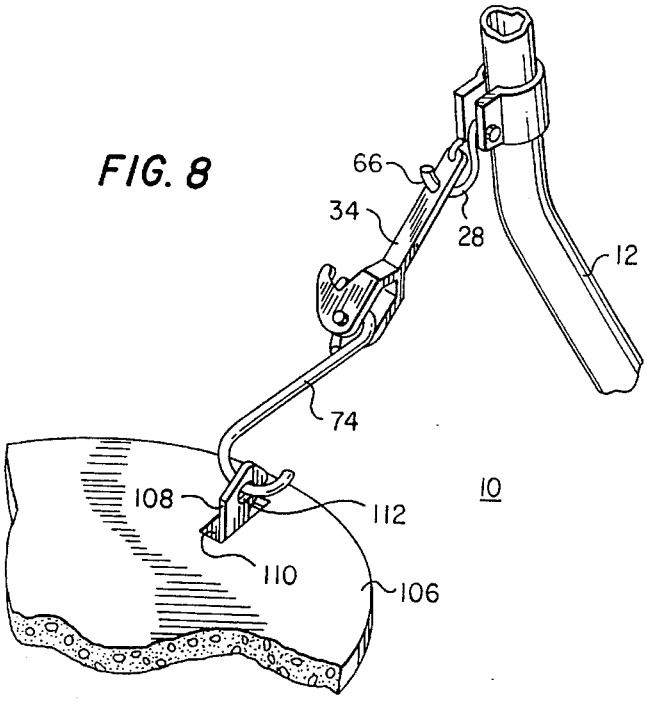
FIG. 8 shows the operation of the present invention in connection with a second type of manhole cover.

FIG. 8 shows the use of tool 10 with a manhole cover 106 that differs from manhole cover 98, shown in FIGS. 6–7. Manhole cover 106 includes a tongue 108 which normally resides within a recess 110. Tongue 108 includes a hole 112. Tool 10 cooperates with manhole cover 106 by rotating link-up unit 34 90° with respect to handle 12 from its orientation shown in FIGS. 6–7. This alternate orientation may be accommodated by inserting S-hook 28 into hole 66. With this alternate orientation, hook 74 extends in the correct direction to engage hole 112 in tongue 108. When tool 10 attaches to tongue 108, manhole cover 106 may be removed generally as discussed above in connection with FIGS. 6–7.

Figure 9:
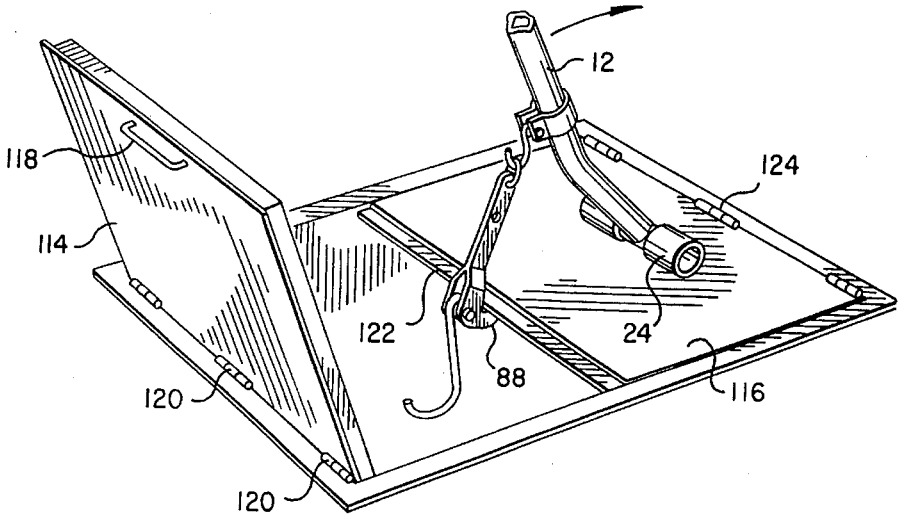
FIG. 9 shows the operation of the present invention in connection with a pull-box type of manhole cover.

FIG. 9 shows the use of tool 10 with hinged manhole covers 114 and 116, which are shown on a structure known to those skilled in the art as a pull-box. Door 114 includes a handle 118 that hook 74 may engage. Door 114 may be opened by placing (not shown) feet 24 on door 114 between hinges 120 and handle 118. The leverage achieved through the use of tool 10 may then be applied to open door 114 by pulling (not shown) handle 12 in the direction of hinges 120.

Door 116 does not have a handle. Thus, claw 88 may be employed to catch an edge 122 of door 116. After placing feet 24 on door 116 between its hinges 124 and edge 122, door 116 may be easily opened by pulling handle 12 in the direction of hinges 124. Since claw 88 includes two, spaced apart fingers 90–92 (see FIG. 4), it tends to remain stably positioned when it engages a surface and pulling forces are applied. Thus, it tends to resist wobbling which might cause it to become instantly and unintentionally disengaged.

Figure 10:
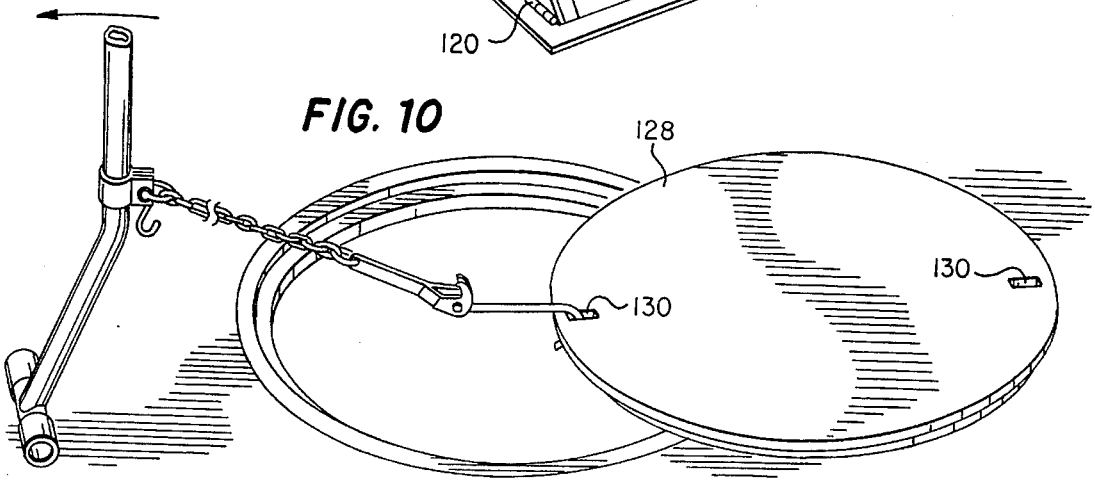
FIG. 10 shows operation of the present invention in connection with replacement of a third type of manhole cover.

FIG. 10 shows the use of tool 10 in connection with the replacement of a manhole cover 128. Manhole cover 128 is similar in configuration to manhole cover 98, discussed above in connection with FIGS. 6–7. However, manhole cover 128 includes holes 130 which are positioned toward the interior of manhole cover 128 from its perimeter. Manhole cover 128 may be removed substantially as discussed above in connection with FIGS. 6–7. Both of covers 98 and 128 may be replaced by hooking hook 74 through a hole 130 (or notch 100 as in FIGS. 6–7) and using the entire length of chain 32 to pull the manhole cover back in place. The distance between hook 74 and handle 12 is extended by the length of chain 32 to permit the placement of handle 12 on the opposite side of an open manhole from the manhole cover. However, the pulling forces are substantially horizontal and the manhole cover is not stuck in its frame when these replacement operations occur. Thus, the use of a chain between handle 12 and hook 74 does not pose a safety hazard. Moreover, the use of clevis 46 to transfer forces from handle 12 to chain 32, rather than requiring chain 32 to be hooked on S-hook 28, prevents damage to tool 10.

In summary, the present invention provides a safe and improved manhole cover removal and replacement tool. Safety is enhanced, at least in part, because the tool of the present invention resists becoming instantly disengaged from a manhole cover during a manhole cover removal operation. In addition, the tool provided by the present invention is specifically adapted for use in connection with a wide variety of manhole cover configurations. Thus, those who must remove and install a variety of manhole covers need not carry a corresponding variety of tools, and need not utilize inappropriate tools in an unsafe manner, to remove and replace a variety of different manhole covers. Furthermore, the tool of the present invention exhibits improved reliability, at least in part, because its chain attaches to its handle securely enough to permit direct pulling on the chain at its attachment point.

The present invention has been described above with reference to a preferred embodiment. However, those skilled in the art will recognize that changes and modifications may be made in this preferred embodiment without departing from the scope of the present invention. For example, the particular relative orientations discussed herein, such as top, bottom, left, right, front, and back, bear no significant relationship to the present invention itself other than as illustrated in the FIGURES. Those skilled in the art will understand that the present invention may be constructed and used in a wide variety of orientations. Likewise, the particular materials and dimensions mentioned herein may be altered by those skilled in the art to meet specific requirements. These and other changes and modifications which are obvious to those skilled in the art are intended to be included within the scope of the present invention.

What is claimed is:

1. A manhole cover tool for engaging a manhole cover residing in a first position and for allowing a person to safely reposition said manhole cover to a second position, said tool comprising:

a rigid handle extending from an anchoring end to a gripping end;

a hook-shaped member for engaging said manhole cover, said hook-shaped member having a first end and a second end which opposes said first end, and said hook-shaped member being configured to exhibit a first radius of curvature through an intermediate portion thereof and a second radius of curvature between said intermediate portion and said second end, said second radius of curvature being less than said first radius of curvature; and means, coupled between said first end of said hook-shaped member and said handle at a location between said anchoring and gripping ends, for substantially restraining rotation of said hook-shaped member relative to said handle, said rotation being substantially restrained in each of two dimensions when said hook-shaped member engages said manhole cover.

2. A manhole cover tool as claimed in claim 1 wherein a transition region between said first and second radii occurs within one inch of said second end.

3. A manhole cover tool for engaging a manhole cover residing in a first position and for allowing a person to safely reposition said manhole cover to a second position, said tool comprising:

a rigid handle extending from an anchoring end to a gripping end;

a hook-shaped member for engaging said manhole cover; and means, coupled between said hook-shaped member and said handle at a location between said anchoring and gripping ends, for substantially restraining rotation of said hook-shaped member relative to said handle, said rotation being substantially restrained in each of two dimensions when said hook-shaped member engages said manhole cover;

said hook-shaped member projecting outward from said rotation restraining means in a first direction; and said tool additionally comprising a claw projecting outward from and rigidly attached to said rotation restraining means in a second direction, said second direction substantially opposing said first direction.

4. A manhole cover tool as claimed in claim 3 wherein said claw is formed with said rotation restraining means into an integral unit.

5. A manhole cover tool as claimed in claim 4 wherein:

said integral unit comprises a rigid member having a first end which couples to said hook-shaped member;

a portion of said rigid member proximate said first end is configured into first and second spaced apart tines; and said claw consists of a first finger member integrally formed with said first tine and a second finger integrally formed with said second tine.

6. A manhole cover tool as claimed in claim 5 wherein said first and second finger members have substantially identical shapes.

7. A manhole cover tool as claimed in claim 5 wherein:

said rigid unit additionally has a second end which opposes said first end;

said rotation restraining means portion of said rigid unit is elongated between said first and second ends; and at least one of said first and second fingers generally projects away from said direction of elongation at an angle of between 45 degrees and 90 degrees.

8. A manhole cover tool as claimed in claim 7 wherein:

said at least one of said first and second fingers includes a stop integrally formed therewith;

said stop resides at a remote end of said finger from said rotation restraining means of said rigid unit; and said stop projects generally towards said second end of said rigid unit.

9. A manhole cover tool for engaging a manhole cover residing in a first position and for allowing a person to safely reposition said manhole cover to a second position, said tool comprising:

a rigid handle extending from an anchoring end to a gripping end;

a hook-shaped member for engaging said manhole cover;

means, coupled between said hook-shaped member and said handle at a location between said anchoring and gripping ends, for substantially restraining rotation of said hook-shaped member relative to said handle, said rotation being substantially restrained in each of two dimensions when said hook-shaped member engages said manhole cover; and means, coupled between said handle and said rotation restraining means, for hand-removable attachment of said rotation restraining means to said handle.

10. A manhole cover tool as claimed in claim 9 wherein said attachment means comprises:

a collar surrounding said handle and having first and second ears projecting outward from said handle;

an S-shaped hook member coupled between said ears; and a link rigidly attached to said rotation restraining means, said link and a portion of said S-shaped hook member being mutually configured for hand-removable attachment of said link to said S-shaped hook member.

11. A manhole cover tool for engaging a manhole cover residing in a first position and for allowing a person to safely reposition said manhole cover to a second position, said tool comprising:

a rigid handle extending from an anchoring end to a gripping end;

a hook-shaped member for engaging said manhole cover;

means, coupled between said hook-shaped member and said handle at a location between said anchoring and gripping ends, for substantially restraining rotation of said hook-shaped member relative to said handle, said rotation being substantially restrained in each of two dimensions when said hook-shaped member engages said manhole cover; and a chain coupled to said rotation restraining means and to said handle.

12. A manhole cover tool as claimed in claim 11 additionally comprising:

a collar surrounding said handle and having first and second ears projecting outward from said handle;

an S-shaped hook member coupled between said ears;

a link rigidly attached to said rotation restraining means, said link and a portion of said S-shaped hook member being mutually configured for hand-removable attachment of said link to said S-shaped hook member, said link additionally being coupled to a first end of said chain; and a clevis coupled to said collar and attached to a second end of said chain.

13. A manhole cover tool as claimed in claim 12 wherein:

said collar and said clevis are mutually configured so that said first and second ears of said collar reside within said clevis; and said tool additionally comprises pinning means extending through said clevis, said S-shaped hook member, and said collar to couple said clevis and said S-shaped hook member to said collar.

14. An apparatus for engaging one of a wide variety of manhole cover types residing in a first position and for allowing a person to safely reposition said one engaged manhole cover to a second position, said apparatus comprising:

a rigid handle extending from an anchoring end to a gripping end;

a hook-shaped member for engaging a corresponding opening in said manhole cover; and a rigid member having a first end coupled to said hook-shaped member and having a second end, for substantially restraining rotation of said hook-shaped member relative to said handle, said rotation being substantially restrained in each of two dimensions when said hook-shaped member engages said manhole cover opening, wherein a portion of said rigid member proximate said first end is configured into first and second spaced apart tines, and said hook-shaped member pivotably couples to said rigid member between said first and second tines;

a collar surrounding said handle and having first and second ears projecting outward from said handle;

an S-shaped hook member coupled between said ears; and a link rigidly attached to said rigid member proximate said second end thereof, said link and said S-shaped hook member being mutually configured for hand-removable attachment of said link to said S-shaped hook member.

15. An apparatus as claimed in claim 14 wherein:

said hook-shaped member projects outward from said rotation restraining means in a first direction; and said restraining means has a hole extending therethrough in a direction substantially perpendicular to said first direction, said hole being mutually configured for hand-removable attachment of said restraining means to said S-shaped hook member.

16. An apparatus for engaging any one of a wide variety of manhole cover types residing in a first position and for allowing a person to safely reposition said engaged manhole cover to a second position, said apparatus comprising:

a rigid handle extending from an anchoring end to a gripping end;

a hook-shaped member for engaging a corresponding opening in said manhole cover;

means, pivotably coupled to said hook-shaped member and pivotably coupled to said rigid handle, for substantially restraining rotation of said hook-shaped member relative to said handle, said rotation being substantially restrained in each of two dimensions when said hook-shaped member engages said manhole cover opening;

said hook-shaped member projecting outward from said rotation restraining means in a first direction; and said apparatus additionally comprising a claw projecting outward from and rigidly attached to said rotation restraining means in a second direction, said second direction substantially opposing said first direction.

17. An apparatus as claimed in claim 16 wherein said claw is formed with said rotation restraining means into an integral unit.

18. An apparatus as claimed in claim 17 wherein:

said integral unit comprises a rigid member having a first end which couples to said hook-shaped member;

a portion of said rigid member proximate said first end is configured into first and second spaced apart tines; and said claw consists of a first finger member integrally formed with said first tine and a second finger integrally formed with said second tine.

19. An apparatus for engaging any one of a wide variety of manhole cover types residing in a first position and for allowing a person to safely reposition said engaged manhole cover to a second position, said apparatus comprising:

a rigid handle extending from an anchoring end to a gripping end;

a hook-shaped member for engaging a corresponding opening in said manhole cover;

means, pivotably coupled to said hook-shaped member and pivotably coupled to said rigid handle, for substantially restraining rotation of said hook-shaped member relative to said handle, said rotation being substantially restrained in each of two dimensions when said hook-shaped member engages said manhole cover opening; and a chain coupled to said rotation restraining means and to said handle.

20. An apparatus as claimed in claim 19 additionally comprising:

a collar surrounding said handle and having first and second ears projecting outward from said handle;

an S-shaped hook member coupled between said ears;

a link rigidly attached to said rotation restraining means, said link and a portion of said S-shaped hook member being mutually configured for hand-removable attachment of said link to said S-shaped hook member, said link additionally being coupled to a first end of said chain; and a clevis coupled to said collar and attached to a second end of said chain.

21. An apparatus for engaging any one of a wide variety of manhole cover types residing in a first position and for allowing a person to safely reposition said engaged manhole cover to a second position, said apparatus comprising:

a rigid handle extending from an anchoring end to a gripping end;

a collar surrounding said handle and having first and second ears projecting outward from said handle;

an S-shaped hook member coupled between said ears;

a rigid member having first and second ends, wherein a portion of said rigid member proximate said first end thereof is configured into first and second spaced apart tines, and said rigid member includes a rigid link proximate said second end thereof, said link being mutually configured for hand-removable attachment of said link to said S-shaped hook member;

a hook-shaped member for engaging a corresponding opening in said manhole cover, said hook-shaped member being pivotably coupled to said rigid member between said first and second tines, and said hook-shaped member projecting away from said rigid member in a first direction;

a claw projecting in a second direction outward from and being rigidly attached to said rigid member first end, said second direction substantially opposing said first direction; and a chain coupled to said rigid member and to at least one of said rigid handle and said collar.

22. An apparatus as claimed in claim 21 wherein:

said hook-shaped member has a first end which couples to said rigid member and a second end which opposes said first end; and said hook-shaped member is configured to exhibit a first radius of curvature through an intermediate portion thereof and a second radius of curvature between said intermediate portion and said second end, said second radius of curvature being less than said first radius of curvature.

23. An apparatus as claimed in claim 21 wherein said claw is formed with said rigid member into an integral unit.

24. An apparatus as claimed in claim 23 wherein said claw consists of a first finger member integrally formed with said first tine and a second finger member integrally formed with said second tine, said first and second fingers having substantially identical shapes.

* * * * *